US006571414B1

(12) United States Patent
Krenzler

(10) Patent No.: US 6,571,414 B1
(45) Date of Patent: Jun. 3, 2003

(54) TOOL FOR DRESSING THE COVER OF A GOLF BALL

(76) Inventor: Leo M. Krenzler, 20603 Island Parkway East, Sumner, WA (US) 98390

( * ) Notice: Subject to any disclaimer, the term of this patent is extended or adjusted under 35 U.S.C. 154(b) by 0 days.

(21) Appl. No.: 10/198,794

(22) Filed: Jul. 18, 2002

(51) Int. Cl.[7] ..... B25F 1/00
(52) U.S. Cl. ..... 7/169; 451/559
(58) Field of Search ..... 7/169, 170, 120; 451/540, 552, 559, 913; 473/282–286, 408; 15/105

(56) References Cited

U.S. PATENT DOCUMENTS 3,769,760 A * 11/1973 Kritske ..... 451/540
4,785,586 A * 11/1988 Kratfel ..... 451/552
5,004,239 A * 4/1991 Wettstein ..... 473/282
5,484,329 A * 1/1996 Engelbrektson ..... 451/523
5,997,411 A * 12/1999 Holub ..... 473/282
6,036,386 A * 3/2000 McDonald ..... 401/10
6,076,224 A * 6/2000 Pacifico et al. ..... 15/210.1
6,148,464 A * 11/2000 Shioda ..... 15/118
6,270,424 B1 * 8/2001 Holub ..... 473/286

FOREIGN PATENT DOCUMENTS

GB 2120948 A * 12/1983 ..... A63B/47/04

* cited by examiner

*Primary Examiner*—Joseph J. Hail, III
*Assistant Examiner*—David B. Thomas
(74) *Attorney, Agent, or Firm*—Delbert J. Barnard

(57) ABSTRACT

A concave recess (14) is provided in a member (10) that includes a portion offset from the recess (14) for use as a handle. The base of the recess (14) is provided with a concave abrasive surface (16). A projecting imperfection (18) on the surface of the golf ball (GB) is moved into the cavity (14) and against the concave abrasive surface (16). Then, the tool (10) is moved relative to the golf ball (GB) so that the abrasive material (16) will wear away the surface projection (18) on the golf ball (GB).

16 Claims, 4 Drawing Sheets

FIG. 1
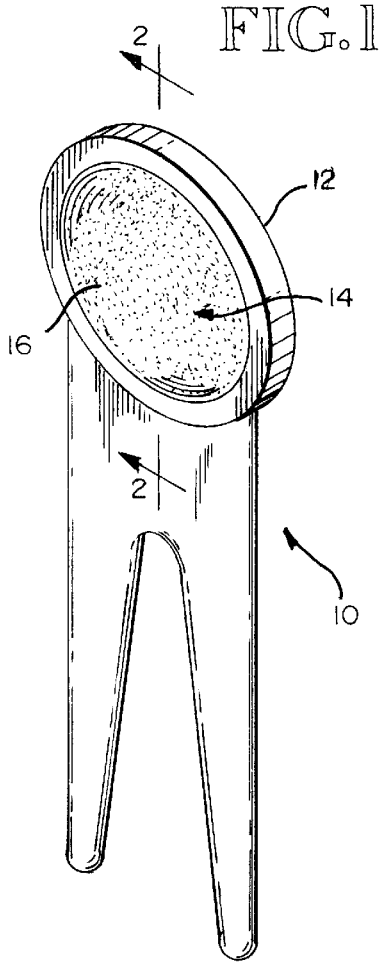
FIG. 2
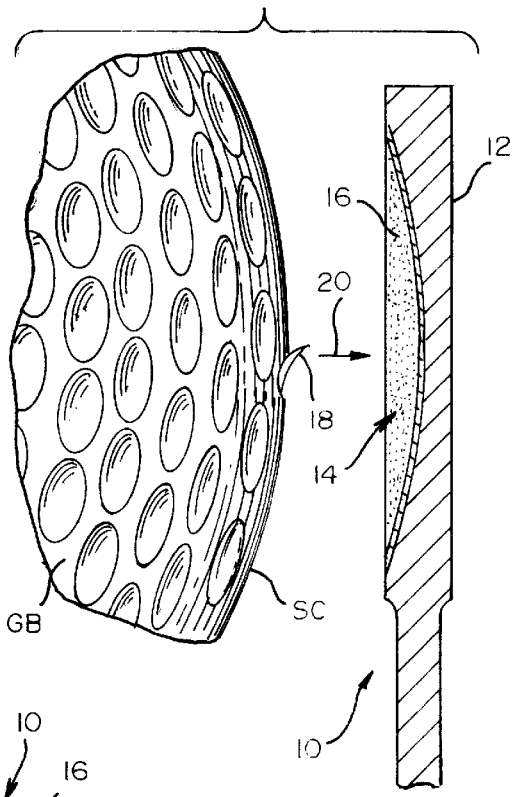
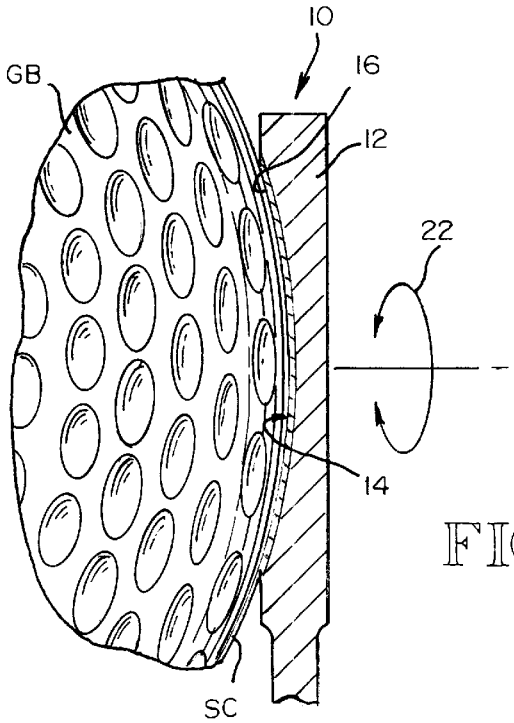
FIG. 3

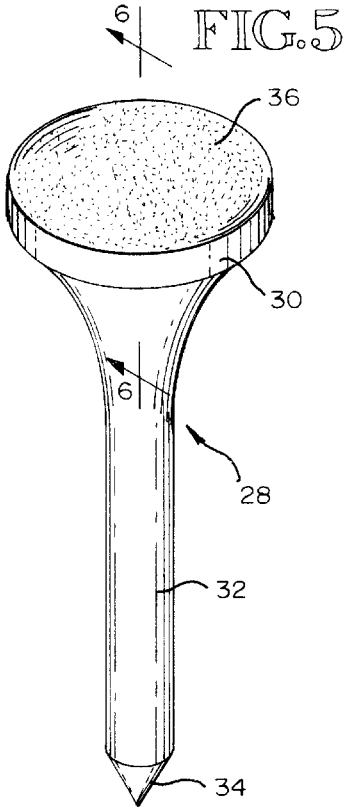
FIG. 5
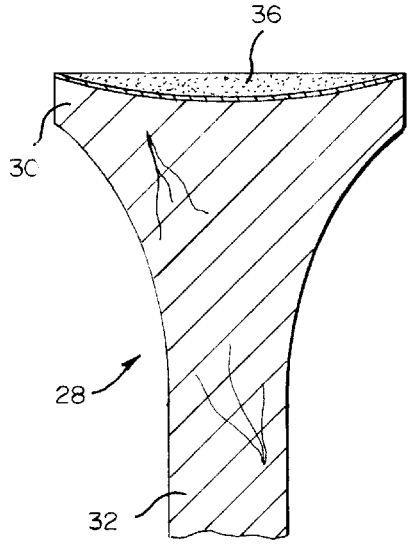
FIG. 6
FIG. 7
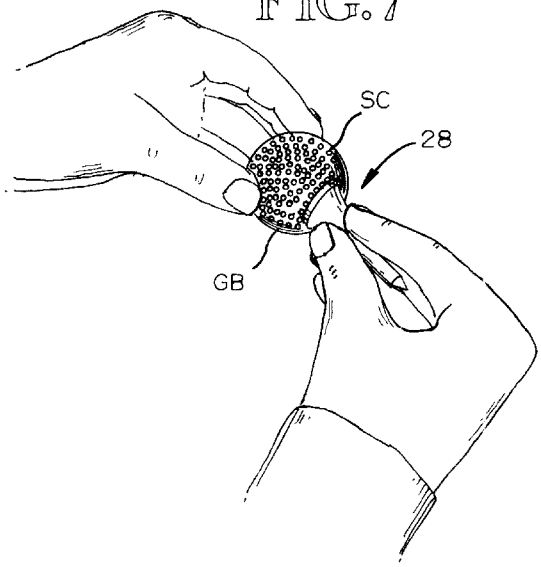
FIG. 8
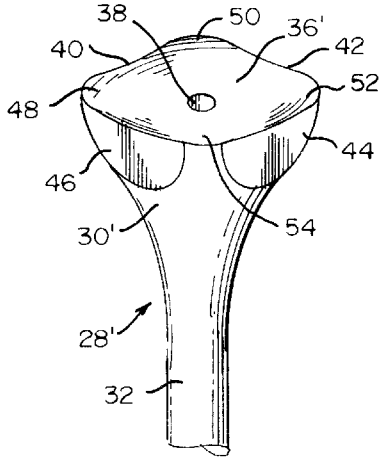

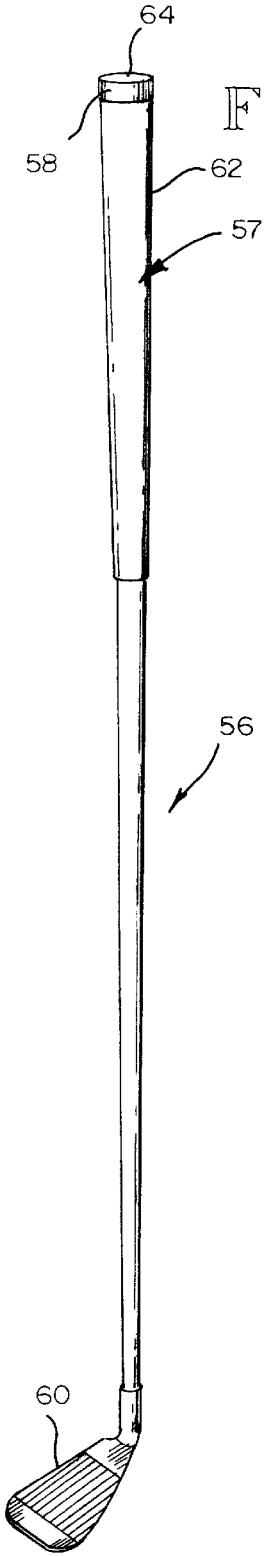
FIG. 9
FIG. 10
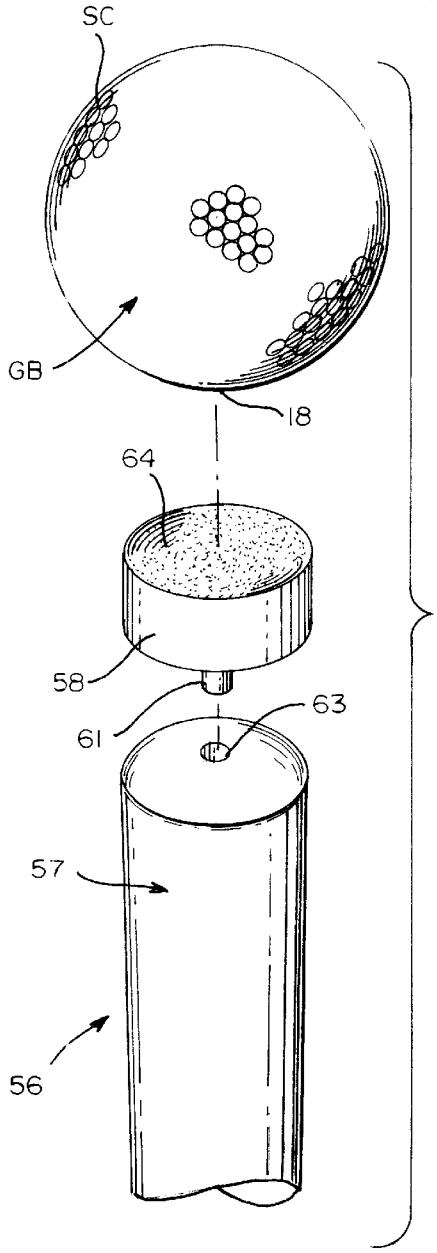

TOOL FOR DRESSING THE COVER OF A GOLF BALL

TECHNICAL FIELD

This invention relates to a tool for dressing the cover of a golf ball. More particularly, it relates to an abrading tool for removing protruding surface imperfections from the cover of a golf ball.

BACKGROUND OF THE INVENTION

During use, golf balls receive nicks and cuts in their outer covers in response to being struck by the head of a golf club. At times, the club head striking the golf ball pushes up a portion of the cover and produces a surface defect that projects outwardly beyond the normal outer surface of the cover. There is a need for a tool for removing such an imperfection from the cover of a golf ball. There is also a need for such a tool that is a part of a golfing accessory that is normally carried by a golfer, including but not limited to a divot replacing fork, a golf club and a golf ball tee. The primary object of the present invention is to provide a tool for dressing the cover of a golf ball and in particular such a tool that is incorporated into a common golfing accessory.

BRIEF SUMMARY OF THE INVENTION

The tool of the present invention comprises a rigid body and a concave recess in the rigid body having a curvature substantially matching the curvature of the cover of a golf ball. The concave recess has an abrasive concave surface. A golf ball having a surface imperfection is placed into the recess with the imperfection directed towards the abrasive surface. Then, the golf ball is moved relatively across the abrasive surface so that the abrasive surface abrades away and removes any projecting portion of the cover.

In preferred form, the tool comprises a rigid body having a portion that is offset from the concave recess and is capable of serving as a handle for the tool. This handle portion of the tool is grasped and used to hold the rigid body in one hand while the other hand is holding the golf ball. The golf ball is then moved relatively across the concave abrasive surface until its cover is again substantially smooth.

According to one aspect of the invention, the rigid body includes first and second sides and a concave recess on both sides, each including an abrasive concave surface. Preferably one of the abrasive surfaces is rougher than the other abrasive surface. In preferred form, each concave abrasive surface has a curvature that is slightly flatter than the curvature of the cover of a golf ball.

According to another aspect of the invention, the rigid body is a golf ball tee having a golf ball supporting head at one end and a shank extending from the head to a point at its opposite end. The head may be round or may have four flat sides, each of which is substantially perpendicular to each adjacent side. The latter construction provides the concave abrasive surface with corner regions that can be used to dress the cover.

According to a further aspect of the invention, the rigid body may be a golf club handle having an end member in which the concave recess is formed. The recess and its abrasive concave surface project longitudinally outwardly from the golf club. In preferred form, the end member is secured to the golf club by an insert that fits into an opening in the handle end of the golf club.

It is within the scope of the invention to incorporate the concave abrasive surface into other objects and, in particular, into other objects that are normally carried by a golfer, including but not limited to a divot replacing tool.

Other objects, advantages and features of the invention will become apparent from the description of the best mode set for below, from the drawings, from the claims and from the principles that are embodied in the specific structures that are illustrated and described.

BRIEF DESCRIPTION OF THE SEVERAL VIEWS OF THE DRAWINGS

Like reference numerals and letters are used to designate like parts throughout the several views of the drawing, and:

FIG. 1 is a pictorial view of a first embodiment of the invention, such view looking towards a concave recess that has an abrasive concave surface that is adapted to receive a surface portion of a golf ball;

FIG. 2 is an enlarged scale fragmentary sectional view taken substantially along 2—2 of FIG. 1, such view showing the surface portion of a golf ball spaced outwardly from the abrasive concave surface;

FIG. 3 is a view like FIG. 2, but showing the golf ball moved into the concave recess, and showing a circular arrow that denotes a rotational movement of the golf ball relative to the tool while the golf ball is in contact with the abrasive concave surface;

FIG. 5 is a pictorial view of a golf ball tee, taken from above and looking towards the top and one side of the tee, such view showing that the upper surface of the tee is provided with an upwardly opening concave recess that includes an abrasive concave surface;

FIG. 6 is an enlarged scale fragmentary sectional view taken substantially along line 6—6 of FIG. 5;

FIG. 7 is a pictorial view showing a person holding a golf ball in his/her left hand and the golf ball tee of FIG. 5 in his/her right hand, and showing a surface portion of the golf ball within the abrasive concave surface on the head of the golf ball tee;

FIG. 8 is a fragmentary view like FIG. 5, but showing a golf ball tee having a head that includes four sides, each of which is substantially perpendicular to each adjacent side, and further showing an opening or recess at the center of the abrasive concrete surface;

FIG. 9 is a pictorial view of a golf club taken from above and looking towards the top and one side of the golf club, such view showing an end member at the outer end of the golf club handle; and FIG. 10 is an enlarged scale view of the end portion of the golf club handle that is shown in FIG. 9, such view showing the end member spaced from the rest of the handle, and further showing an abrasive concave surface at the outer end of the end member, and further showing a golf ball spaced from the abrasive concave surface.

DETAILED DESCRIPTION OF THE INVENTION

Figure 4:
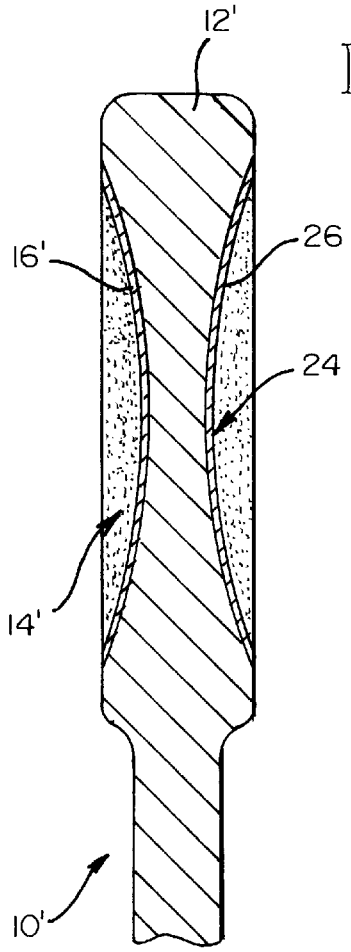
FIG. 4 is a view like FIG. 2, but minus the golf ball, such view showing a second concave recess on the second side of the tool.

FIG. 1 shows a divot repairing tool 10 which is of conventional construction except for its head 12. In this embodiment, the head 12 includes a concave recess 14 on one of its sides. Recess 14 is either equal to or slightly flatter in curvature than the surface curvature SC of a golf ball GB. The concave recess 14 includes a concave abrasive surface 16 which may be similar to the abrasive surface on a piece of sandpaper.

FIG. 2 shows a golf ball GB spaced from the concave recess 14 and including a surface imperfection 18 FIG. 2 includes an arrow 20 which indicates that the golf ball GB is being moved into the recess 14, towards the abrasive surface 16. FIG. 3 shows the surface portion 18 positioned within the recess 14, against the abrasive surface 16. It also shows, by an arrow 22, a back and forth rotating movement of the tool 10 relative to the golf ball GB. The tool 10 can be held still while the golf ball GB is moved. Or, the golf ball GB can be held still while the tool 10 is moved. Or, the golf ball GB and the tool 10 can be moved together. The relative movement functions to move the surface portion 18 relative to the abrasive material 16, causing the abrasive material 16 to abrade away the surface portion 18 and substantially restore the normal surface curvature SG of the golf ball GB at that location.

Figure 4A:
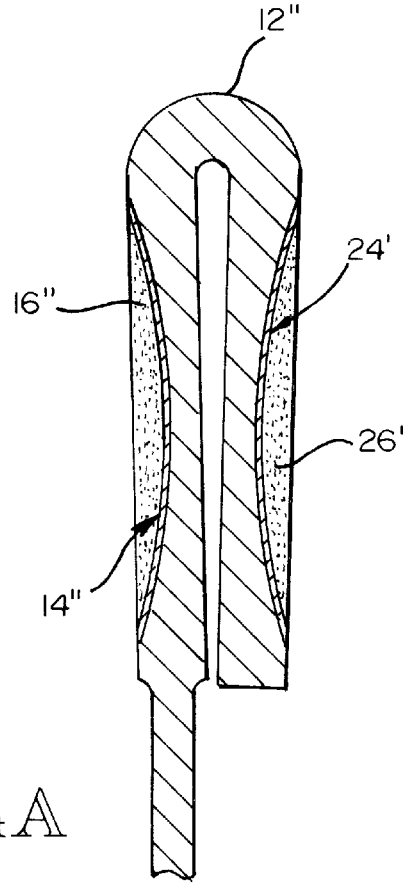
FIG. 4A is a view like FIG. 4, showing a second way of providing a concave recess on both sides of the tool.

FIGS. 4 and 4A show two different ways of providing a second recess 24,24' on the second side of a tool head 12',12". In the embodiment of FIG. 4, the head 12' is made thicker than the head 12 in FIGS. 1–3 so that there is sufficient head material thickened to receive the two cavities 14,24. In the embodiment of FIG. 4, the recess 14' includes an abrasive surface 16' and the concave recess 24 includes an abrasive surface 26. In the embodiment of FIG. 4A, the head 12" has a thickness substantially equal to the head 12 in FIGS. 1–3. However, head 12" is longer than head 12 and is folded back on itself. Recess 24' and recess 14" are initially on the same side of the head 12". Then, the portion of the head 12" that includes the recess 26' is folded back into a position behind the portion that includes the recess 14". In the embodiment of FIG. 4A, the recess 14" includes an abrasive surface 16" and the recess 24' includes an abrasive surface 26'. In these embodiments, the abrasive surfaces 16',26 and 16",26' may be identical, or one may be coarser than the other.

FIGS. 5–7 show a golf ball tee 28 having a head 30 and a pointed shank 32 depending from the head 30. Shank 32 has a pointed lower end 34 for facilitating insertion of the shank 32 into the ground. The top of the head 30 includes a concave recess having an abrasive concave surface 36. The curvature of surface 36 is substantially complementary to the outer surface of the golf ball GB. That is, the curvatures are substantially the same or the curvature of the surface 36 is slightly flatter than the surface curvature SC of the golf ball GB. The abrasive surface 36 is used in the same manner as the abrasive surfaces 16,16',16",26,26'. FIG. 7 shows a person holding a golf ball GB in his/her left hand and holding the tee 28 in his/her right hand. A region on the cover of the golf ball CB that includes a projection 18 is moved into the cavity and against the concave abrasive surface 36. Then, the golf ball GB is moved relative to the tee 28, or the tee 28 is moved relative to the golf ball GB, or the ball GB and the tee 28 are moved together. This relative movement causes the concave abrasive surface 36 to abrade away the projection 18.

FIG. 8 shows a modified form of the golf ball tee 28'. It has a head 30' that is cut to provide it with four sides 40,42,44,46. The head 30' has a concave recess in its upper end and the recess includes a concave abrasive surface 36'. It may also include a center opening 38 of variable diameter. In this embodiment the head of the tee 30' includes four corner regions 48,50,52,54. When this embodiment is used, the corner regions 46,50,52,54 of the abrasive surface 36' may be placed against the surface projection 18' and used to remove the projection 18'. Use of the corner regions 46,50, 52,54 may make it easier to control the abrading operation.

FIGS. 9 and 10 show a golf club 56 having a handle 57 and a club head 60. The handle 58 includes a cover 62 made from leather or a leather-like material. An end member 58 is provided at the upper end of the handle 57. End member 64 may include a peg 61 that fits into an opening 63 in the upper end of the handle 57. The engagement of the peg 61 in the opening 66 properly positions the end member 64 relative to the rest of the handle 57. Pin 61 may be threaded and the opening 66 may include complementary threads for receiving the threads on the pin 61. Or, the pin 61 and opening 63 may be constructed in such a manner that the pin 61 can be force fitted into the opening 63.

End member 58 includes a concave upper cavity and a concave abrasive surface 64 at the base of the cavity. Surface 64 may substantially equal the surface curvature SC of the golf ball GB. This includes making the surface 64 slightly flatter in curvature than the surface curvature SC of the golf ball GB. As in the earlier embodiments, a surface projection 18 on the golf ball GB is set down into the cavity in member 58 against the concave abrasive surface 68. Then, the golf ball GB is moved relative to the concave abrasive surface 68 to cause the surface 68 to abrade away the surface projection 18 on the golf ball GB.

The abrasive surfaces 16,16',16",26,26',36,36',64 may be provided on the base material substantially the same way that an abrasive surface is applied to a sheet of sandpaper, e.g. grit may be glued to the base material. Or, the concave surface may be formed of a metal that is machined to provide it with sharp teeth, points or ribs, such as are provided on a metal file.

The illustrated embodiments are only examples of the present invention and, therefore, are non-limitive unless specifically claimed. The concave abrasive surface may be provided on some other object or golf accessory. It is also to be understood that many other changes in the particular structure, materials and features of the invention may be made without departing from the spirit and scope of the invention. Therefore, it is my intention that my patent rights not be limited by the particular embodiments illustrated and described herein, but rather be determined by the following claims, interpreted according to accepted doctrines of patent claim interpretation, including use of the doctrine of equivalence.

What is claimed is:

1. A tool for dressing the cover of a golf ball, comprising:

a rigid body;

a concave recess in said rigid body having a curvature substantially matching the curvature of the cover on a golf ball;

said concave recess having an abrasive concave surface, wherein a golf ball having a surface imperfection can be moved into the concave recess, with the imperfection directed towards the abrasive surface, and the golf ball can be moved while in said concave recess, relatively across the abrasive surface, so that the abrasice surface can abrade and remove any projecting portion of the cover caused by the imperfection; and wherein the curvature of the concave recess is a slightly flatter curvature than the curvature of the cover of the golf ball.

2. The tool of claim 1, wherein the rigid body includes a portion offset from the concave recess that can be grasped and used to hold the rigid body in one hand while the other hand is holding the golf ball and moving it relatively across the abrasive surface in the concave recess.

3. The tool of claim 1, wherein the rigid body is a golf club having a handle end and a club head end, and an end member at the handle end, said end member including the abrasive concave surface and said surface projecting longitudinally of the golf club away from the golf club.

4. The tool of claim 3, wherein the end member is secured to the golf club by an insert that fits into an axial opening in the handle end of the golf club.

5. A tool for dressing the cover of a golf ball, comprising:

a rigid body;

a concave recess in said rigid body having a curvature substantially matching the curvature of the cover on a golf ball;

said concave recess having an abrasive concave surface, wherein a golf ball having a surface imperfection can be moved into the concave recess, with the imperfection directed towards the abrasive surface, and the golf ball can be moved while in said concave recess, relatively across the abrasive surface, so that the abrasive surface can abrade and remove any projecting portion of the cover caused by the imperfection;

wherein the rigid body includes a portion offset from the concave recess that can be grasped and used to hold the rigid body in one hand while the other hand is holding the golf ball and moving it relatively across the abrasive surface in the concave recess; and wherein the rigid body includes first and second sides and a concave recess on each side, each of which includes an abrasive concave surface.

6. The tool of claim 5, wherein one of the abrasive concave surfaces is rougher than the other abrasive concave surface.

7. The tool of claim 6, wherein the rigid body includes a portion offset from the concave recesses that can be grasped by one hand of the user while the other hand holds the golf ball and moves it across the abrasive surface in one of the concave recesses.

8. The tool of claim 5, wherein the curvature of the concave recess is a slightly flatter curvature than the curvature of the cover of the golf ball.

9. The tool of claim 6, wherein the curvature of the concave recess is a slightly flatter curvature than the curvature of the cover of the golf ball.

10. The tool of claim 7, wherein the curvature of the concave recess is a slightly flatter curvature than the curvature of the cover of the golf ball.

11. A tool for dressing the cover of a golf ball, comprising:

a rigid body;

a concave recess in said rigid body having a curvature substantially matching the curvature of the cover on a golf ball;

said concave recess having an abrasive concave surface, wherein a golf ball having a surface imperfection can be moved into the concave recess, with the imperfection directed towards the abrasive surface, and the golf ball can be moved while in said concave recess, relatively across the abrasive surface, so that the abrasive surface can abrade and remove any projecting portion of the cover caused by the imperfection; and wherein the rigid body is a golf ball tee having a golf ball supporting head and a pointed shank extending from the head and which in use is inserted in the ground, and said concave recess forms the upper surface of the head of the golf ball tee.

12. The tool of claim 11, wherein the head of the golf ball tee has four sides, each of which is substantially perpendicular to each adjacent side.

13. The tool of claim 11, comprising a recess in the head of the golf ball tee, substantially at the center of the abrasive concave surface.

14. The tool of claim 11, wherein the curvature of the concave recess is a slightly flatter curvature than the curvature of the cover of the golf ball.

15. The tool of claim 14, wherein the head of the golf ball tee has four sides, each of which is substantially perpendicular to each adjacent side.

16. The tool of claim 15, comprising a recess in the head of the golf ball tee, substantially at the center of the abrasive concave surface.

* * * * *